United States Patent [19]

Lievens et al.

[11] 4,003,228

[45] Jan. 18, 1977

[54] SECURITY APPARATUS FOR VEHICLE COMMUNICATIONS ACCESSORY

[76] Inventors: James Lee Lievens, 109 Third St., Rustic Acres, Colona, Ill. 61241; Stanely Clarence De Decker, 24055 80th Ave. North, Port Byron, Ill. 61275

[22] Filed: Mar. 23, 1976

[21] Appl. No.: 669,512

[52] U.S. Cl. ..... 70/58; 70/18; 70/232

[51] Int. Cl.[2] ..... E05B 73/00

[58] Field of Search ..... 70/14, 15, 39, 18, 229, 70/230, 231, 232, DIG. 57, 57, 58

[56] References Cited

UNITED STATES PATENTS

| | | | |
|---|---|---|---|
| 804,387 | 11/1905 | Davis | 70/57 |
| 2,565,659 | 8/1951 | Kontra | 70/232 |
| 2,955,453 | 10/1960 | Mitchell | 70/58 |
| 3,380,267 | 4/1968 | Winchester | 72/232 |

FOREIGN PATENTS OR APPLICATIONS

| | | | |
|---|---|---|---|
| 532,379 | 8/1955 | Italy | 70/232 |

*Primary Examiner*—Robert L. Wolfe
*Attorney, Agent, or Firm*—Leydig, Voit, Osann, Mayer & Holt, Ltd.

[57] ABSTRACT

A citizen band radio is secured within a vehicle by a high strength cable which is coupled to the radio by a locking device mounted on the antenna connector of the radio.

7 Claims, 5 Drawing Figures

SECURITY APPARATUS FOR VEHICLE COMMUNICATIONS ACCESSORY

BACKGROUND OF THE INVENTION

This invention relates in general to security apparatus and more particularly to security apparatus for discouraging the theft of a vehicle communications accessory such as a citizen band radio from the vehicle. Such radios have recently attained very high popularity and most usually are secured to the underside of the dash of a car or truck. Being "add-on" equipment rather than "built-in" equipment, citizen band radios are readily accessible to thieves from inside the vehicle and frequently are the targets of theft.

SUMMARY OF THE INVENTION

The general aim of the present invention is to provide relatively simple, inexpensive and effective security apparatus for locking an accessory such as a citizen band radio in a vehicle so as to make it difficult for a thief to steal the radio.

A related object is to provide security apparatus which may be installed and used without making any modifications whatsoever to either the radio or the vehicle.

A more detailed object is to provide security apparatus in which a conventional padlock-type locking device coacts with the antenna connector of the radio to enable the latter to be locked in the vehicle.

The invention is particularly characterized by the provision of gripper blocks which surround the antenna connector and which enable the radio to be locked in the vehicle by the locking device and by a high strength security cable.

These and other objects and advantages of the invention will become more apparent from the following detailed description when taken in conjunction with the accompanying drawings.

DETAILED DESCRIPTION OF THE PREFERRED EMBODIMENT

Figure 1:
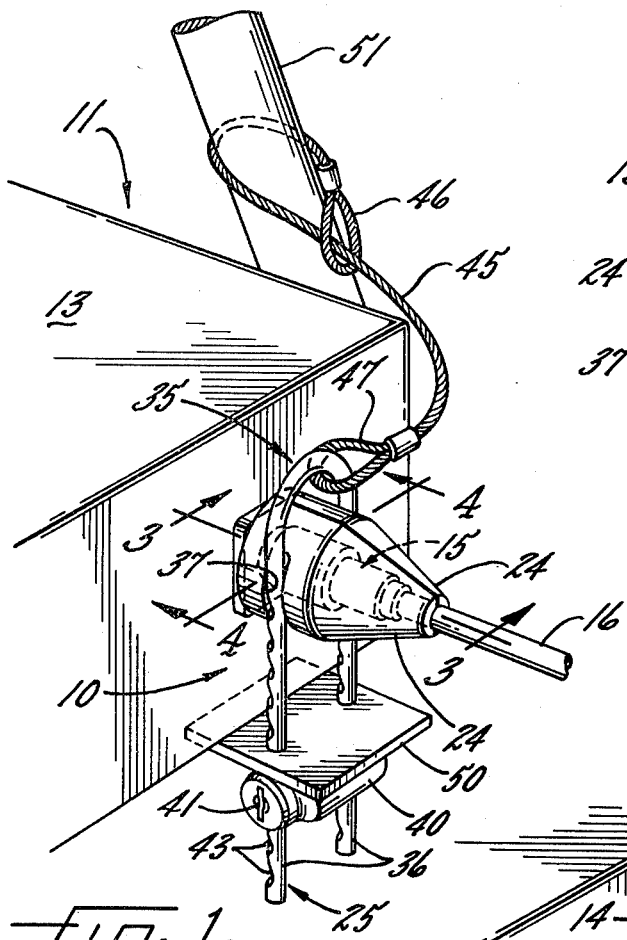
FIG. 1 is a fragmentary perspective view of a vehicle communications accessory equipped with new and improved security apparatus embodying the unique features of the present invention.

As shown in the drawings for purposes of illustration, the invention is embodied in security apparatus 10 for discouraging the theft of a communications accessory 11 from a vehicle. While the security apparatus may be used with accessories of various types, the particular communications accessory 11 which is shown herein is a citizen band radio. Such a radio includes a box-like case 13 adapted to be removably fastened beneath the dash of the vehicle and having top, bottom, side and rear walls.

Figure 5:
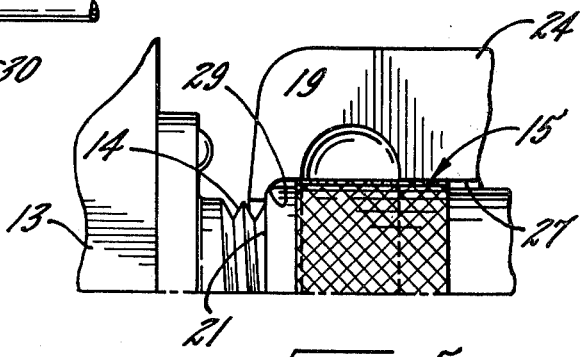
FIG. 5 is an enlarged view of parts shown in FIG. 3.

A conventional fitting 14 (FIG. 3) is attached rigidly to and extends rearwardly from the rear wall of the case 13 and is in the form of an externally threaded jack adapted to be coupled to a connector 15 on the end of an antenna cable 16 leading to an external antenna. The connector 15 is of the standard type used with virtually all citizen band radios and herein is shown as being an Amphenol No. PL-259 connector. Such a connector includes an inner plug 17 secured to the end of the cable and adapted to be telescoped into the jack 14. Rotatably surrounding the forward portion of the plug is an outer nut 19 which is adapted to be threaded onto the jack 14. When the nut is tightened snugly on the jack, the plug is engaged by an inwardly projecting annular flange 20 on the nut thereby to keep the plug securely coupled to the jack. When the nut 19 is snugly tightened, the forwardly facing annular shoulder 21 defined by the extreme forward end of the nut is spaced rearwardly a short distance from the rear wall of the case 13 as shown in FIG. 5.

The present invention contemplates the provision of novel security apparatus 10 which may be quickly and easily installed on the antenna connector 15 without making any modifications to the radio 11 or the vehicle and which, when installed, serves to make it difficult for a thief to remove the radio from the vehicle. The security apparatus is further characterized by the fact that it utilizes a number of readily available commercial items of a standard nature and thus may be packaged and sold without need for an extensive manufacturing operation and without need of a large investment in special tooling.

Figure 4:
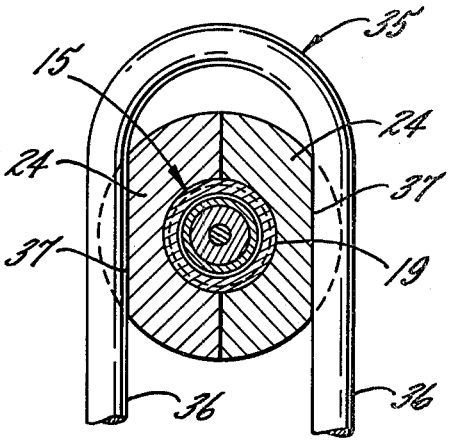
FIGS. 3 and 4 are enlarged fragmentary cross-sections taken substantially along the lines 3—3 and 4—4, respectively, of FIG. 1.
Figure 2:
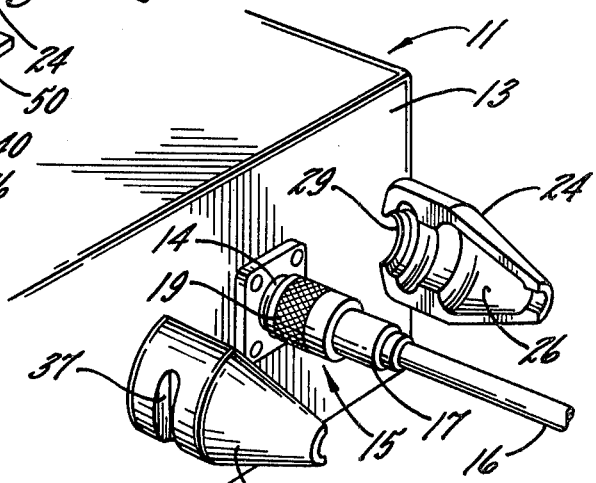
FIG. 2 is a perspective view showing the gripper blocks prior to their installation on the radio.
Figure 3:
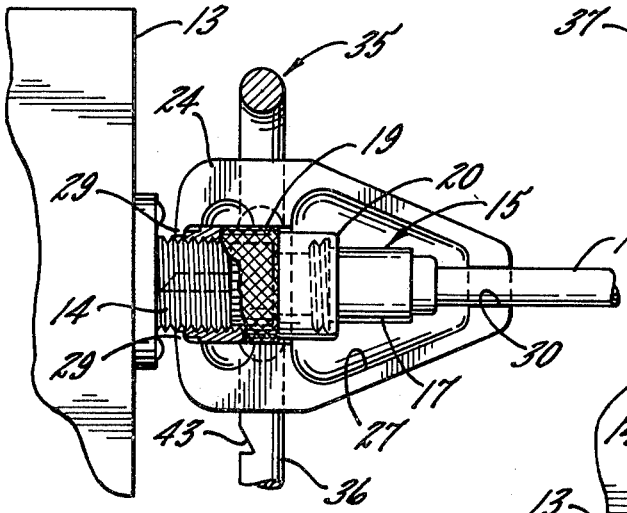

More specifically, the security apparatus 10 includes a pair of gripper blocks 24 which are adapted to be installed on the antenna connector 15 and which serve as a mounting means for a locking device 25. In this instance, the two gripper blocks are precisely identical to one another and are cast from aluminum or other suitable material. Each block is generally semi-circular in radial cross-section (see FIG. 4) and tapers from a large diameter forward end to a smaller diameter rearward end as shown in FIGS. 2 and 3. Formed within one side of each block is an opening 26 (FIG. 2) and, when the two blocks are placed together in face-to-face relation on opposite sides of the connector 15, the two openings define a cavity 27 (FIG. 3) for receiving the connector.

The cavity 27 extends from the forward ends of the blocks 24 to the rear ends thereof and is of suitable size and shape to accommodate the connector 15. At its extreme forward end, the cavity 27 is formed with a forward portion having a diameter just slightly larger than that of the jack 14. Just rearwardly of the forward portion, the cavity is enlarged somewhat so as to define a rearwardly facing and inwardly projecting internal annular shoulder 29 (FIG. 5) whose minimum diameter is smaller than the outside diameter of the forwardly facing shoulder 21 defined at the extreme forward end of the connector nut 19. The extreme rear portion of the cavity 27 is reduced to a diameter of approximately one-fourth inch as indicated at 30 in FIG. 3 and thus the antenna cable 16 fits closely within the rear portion of the cavity.

When positioned in face-to-face relation on opposite sides of the antenna connector 15, the two gripper blocks 24 form a generally bullet-shaped shroud around the connector and the forward end portion of the antenna cable 16. With the blocks so positioned, the rearwardly facing shoulder 29 (FIG 5) defined within the cavity 27 is located between the rear wall of the radio case 13 and the forwardly facing shoulder 21 on the forward end of the connector nut 19. Thus, the rearwardly facing shoulder 29 engages the forwardly facing shoulder 21 to prevent the gripper blocks 24 from being pulled rearwardly off of the connector nut 19.

The locking device 25 is used to prevent the gripper blocks 24 from being separated sidewise from the connector 15. In this instance, the locking device is a standard, commercially available item and comprises a U-shaped shackle 35 (FIG. 4) having downwardly extending legs 36 adapted to embrace the gripper blocks 24. Vertically extending grooves 37 (FIG. 2) are formed in the outboard sides of the gripper blocks and receive the legs 36 in order to locate the shackle on the blocks and to prevent the shackle from being pulled forwardly or rearwardly off of the blocks.

Upward removal of the shackle 35 from the gripper blocks 24 is prevented by a lock tumbler 40 (FIG. 1) which forms part of the locking device 25 and which may be purchased as a unit with the shackle 35. The lock tumbler includes two spaced holes through which the legs 36 of the shackle may be inserted when a key (not shown) is located in a slot 41 in the tumbler. When the key is removed, detents (not shown) within the tumbler move into locking engagement with notches 43 (FIG. 3) in the legs 36 of the shackle 35 and prevent removal of the shackle from the tumbler. Several notches are formed along each leg of the shackle so that the tumbler and the shackle may be locked together at various positions along the legs of the shackle.

The security apparatus 10 is completed by two additional items, namely, (1) a security cable 45 (FIG. 1) having loops 46 and 47 at its ends and (2) a metal position plate 50 adapted to be located beneath the bottom wall of the radio case 13 between the gripper blocks 24 and the tumbler 40 and formed with two spaced holes for receiving the legs 36 of the shackle 35. The security cable 45 is made of braided wire sheathed with plastic and is of the difficult-to-cut type which is conventionally available for use with bicycle locks and the like.

To install the security apparatus 10, the security cable 45 is wrapped around the steering wheel column 51 (FIG. 1) or other fixed object in the vehicle and the loop 47 is threaded through the loop 46 so as to tie the cable to the steering wheel column. With the shackle 35 separated from the tumbler 40, the loop 47 is threaded onto the shackle from the free end of one of the legs 36 thereof.

With the antenna connector 15 coupled snugly to the jack 14, the two gripper blocks 24 are placed on opposite sides of the connector to locate the shoulder 29 forwardly of the shoulder 21 and to enshroud the connector and the forward end of the antenna cable 16. The shackle 35 with the attached security cable 45 then is slipped downwardly over the blocks 24 and into the grooves 37 thereof with one hand while the blocks are being held together with the other hand. Once installed, the shackle holds the blocks against sidewise separation.

Next, the position plate 50 is slid upwardly along the legs 36 of the shackle 35 and is located against the bottom of the radio case 13. Finally, the lock tumbler 40 is slid upwardly along the legs 36 and against the underside of the plate 50 and is locked in place by removing the key from the slot 41.

With the foregoing arrangement, the radio 11 is tied to the steering wheel column 51 by the high strength security cable 45. That is to say, one end of the cable is secured to the steering wheel column while the other end of the cable is captivated within the shackle 35. The shackle is locked in place by the tumbler 40 and the position plate 50 and serves to prevent sidewise removal of the gripper blocks 24 from the antenna connector 15. The gripper blocks, in turn, serve as a means for mounting the shackle on the connector 15 and are prevented from being removed rearwardly from the connector by virtue of engagement of the shoulder 29 with the shoulder 21. The position plate 50 prevents the gripper blocks 24 and the shackle 35 from being turned relative to the radio case 13 and thus a thief cannot free the radio 11 by releasing the radio from beneath the dash and then turning the radio in an attempt to unthread the jack 14 from the connector nut 19. Rather than using a separate position plate, an arm or plate may be formed as part of the shackle 35 or tumbler 40 and may engage one of the walls of the case 13 to prevent relative turning between the case and the shackle.

From the foregoing, it will be apparent that the present invention brings to the art new and improved security apparatus 10 which may be installed on the standard antenna connector 15 of the radio 11 and which may be installed without the use of tools and without need of making any modifications to the radio or vehicle. The locking device 25 and the security cable 45 may be purchased from many sources and thus the only special items required for the security apparatus are the gripper blocks 24 and the position plate 50. The position plate is extremely simple to manufacture and, because the two gripper blocks 24 are identical, both blocks can be cast from the same dies.

We claim:

1. Security apparatus for a vehicle communications accessory having a case with top, bottom, side and rear walls and having a connector attached threadably to a complementary fitting projecting rearwardly from said rear wall, said connector being of substantially circular cross-section and having a forwardly facing annular shoulder which is spaced rearwardly from said rear wall when said connector is attached to said fitting, said security apparatus comprising at least two separable blocks each formed with an opening in one side thereof, said blocks being positionable on opposite sides of said connector with the openings in the blocks defining a cavity for receiving said connector, means at the forward end portion of said cavity and defining a rearwardly facing annular shoulder whose smallest diameter is smaller than the largest diameter of said forwardly facing annular shoulder, said rearwardly facing shoulder being disposed between said rear wall and said forwardly facing shoulder and being engageable with the latter to prevent rearward removal of said blocks from said connector, a locking device comprising a substantially U-shaped shackle having legs straddling said blocks and operable to prevent sidewise separation of said blocks, said locking device further comprising a key-operated lock spanning the legs of said shackle and selectively releasable from at least one of said legs to permit removal of said shackle from said blocks, and a flexible line having one end portion captivated by said shackle and having an opposite end portion adapted for attachment to a fixed object.

2. Security apparatus as defined in claim 1 further including means associated with said locking device and engageable with one of said walls to prevent said locking device from being turned relative to said case.

3. Security apparatus as defined in claim 2 in which said means comprise a plate having holes for receiving the legs of said shackle and having a forward portion adapted to underlie and engage the bottom wall of said case.

4. Security apparatus as defined in claim 1 in which slots are formed in the outboard sides of said blocks and receive the legs of said shackle.

5. Security apparatus as defined in claim 1 in which the rear end portion of said cavity defines an opening having a diameter of approximately one-fourth inch.

6. Security apparatus as defined in claim 1 in which spaced holes are formed through said lock and receive the legs of said shackle, there being notches formed in and spaced along each of said legs and enabling said lock to be anchored at various positions along said legs.

7. Security apparatus as defined in claim 1 in which said line comprises a metal cable, there being a loop at each end of said cable.

* * * * *